US008857129B2

(12) United States Patent
Beranek

(10) Patent No.: US 8,857,129 B2
(45) Date of Patent: Oct. 14, 2014

(54) FRAME ASSEMBLY HAVING A CORNER KEY

(75) Inventor: Gerald D. Beranek, Lone Rock, WI (US)

(73) Assignee: Proformance Maufacturing, Inc., Lone Rock, WI (US)

( * ) Notice: Subject to any disclaimer, the term of this patent is extended or adjusted under 35 U.S.C. 154(b) by 0 days.

(21) Appl. No.: 13/588,758

(22) Filed: Aug. 17, 2012

(65) Prior Publication Data

US 2013/0205706 A1 Aug. 15, 2013

Related U.S. Application Data

(60) Provisional application No. 61/555,384, filed on Nov. 3, 2011, provisional application No. 61/558,919, filed on Nov. 11, 2011, provisional application No. 61/587,364, filed on Jan. 17, 2012.

(51) Int. Cl.

| | |
|---|---|
| ***E06B 3/00*** | (2006.01) |
| ***E04C 2/38*** | (2006.01) |
| ***E06B 3/968*** | (2006.01) |
| *E06B 3/964* | (2006.01) |

(52) U.S. Cl.

CPC ..... *E06B 3/9682* (2013.01); *E06B 3/9645* (2013.01)

USPC ..... 52/656.9; 52/204.5; 52/656.5

(58) Field of Classification Search

CPC ..... E06B 3/96; E06B 3/964; E06B 3/9644; E06B 3/9645; E06B 3/968; E06B 3/9681; E06B 3/9682

USPC ..... 52/204.1, 204.5, 656.1, 656.2, 656.4, 52/656.5, 656.7, 656.9

See application file for complete search history.

(56) References Cited

U.S. PATENT DOCUMENTS

| | | | | |
|---|---|---|---|---|
| 2,792,918 | A | 5/1957 | Olsen | |
| 2,816,632 | A * | 12/1957 | Nardulli | 52/656.7 |
| 3,429,602 | A | 2/1969 | Dirilgen | |
| 3,592,289 | A | 7/1971 | Tacke et al. | |
| 3,782,054 | A * | 1/1974 | Goss, Jr. | 403/295 |
| 3,835,613 | A | 9/1974 | Davies | |

(Continued)

OTHER PUBLICATIONS

"File History", from co-owned, co-pending U.S. Appl. No. 13/667,561, Entitled "Frame Members and Assembly Method", filed Nov. 2, 2012 (81 pages).

(Continued)

*Primary Examiner* — Ryan Kwiecinski

(74) *Attorney, Agent, or Firm* — Pauly, DeVries Smith & Deffner LLC

(57) ABSTRACT

In one embodiment, a frame assembly includes at least two frame members, each frame member comprising two mitered ends and defining an interior space divided into at least three longitudinal cavities, wherein one of the at least three cavities is a corner key cavity. The frame assembly further includes at least one corner key, wherein each half of each corner key is configured to fit into one end of one of the corner key cavities to form a corner. When the at least two frame members are joined using the corner key, the corner key cavity is adjacent to the outer perimeter of the frame assembly system. The outer perimeter of the frame assembly includes a contact portion configured to contact another frame assembly or a structure, wherein the corner key cavity extends across at least 90% of the contact portion of the outer perimeter of the frame assembly.

25 Claims, 7 Drawing Sheets

(56) References Cited

U.S. PATENT DOCUMENTS

| | | | | |
|---|---|---|---|---|
| 4,090,799 | A * | 5/1978 | Crotti et al. | 403/401 |
| 4,124,322 | A * | 11/1978 | Parisien | 403/295 |
| 4,164,105 | A | 8/1979 | Herbst et al. | |
| 4,624,091 | A | 11/1986 | Biro | |
| 4,831,804 | A * | 5/1989 | Sayer | 52/475.1 |
| 5,187,886 | A | 2/1993 | Wu et al. | |
| 5,491,940 | A | 2/1996 | Bruchu | |
| 5,603,585 | A | 2/1997 | Bruchu et al. | |
| 5,622,017 | A | 4/1997 | Lynn et al. | |
| 5,687,533 | A | 11/1997 | Bruchu | |
| 5,806,256 | A | 9/1998 | Byrne | |
| 5,837,095 | A | 11/1998 | Bruchu et al. | |
| 6,047,514 | A | 4/2000 | Verch | |
| 6,067,760 | A | 5/2000 | Nowell | |
| 6,073,412 | A | 6/2000 | Verch | |
| 6,088,989 | A | 7/2000 | Matsu et al. | |
| 6,108,997 | A * | 8/2000 | Blais et al. | 52/656.7 |
| 6,513,288 | B1 | 2/2003 | MacDonald et al. | |
| 6,530,183 | B1 * | 3/2003 | Kuei-Yung | 52/204.1 |
| 6,550,210 | B1 | 4/2003 | Levine et al. | |
| 7,150,130 | B2 * | 12/2006 | Kobayashi et al. | 52/210 |
| 7,174,691 | B2 | 2/2007 | de Garay Arellano | |
| 7,207,636 | B2 | 4/2007 | Livingston et al. | |
| 7,677,003 | B2 | 3/2010 | Baughn et al. | |
| D618,363 | S | 6/2010 | Card | |
| D618,822 | S | 6/2010 | Card | |
| 7,806,620 | B1 | 10/2010 | Brochez | |
| 8,001,743 | B2 | 8/2011 | Lambertini | |
| 8,490,347 | B2 | 7/2013 | Valler et al. | |
| 8,511,011 | B2 * | 8/2013 | Emanuel | 52/204.1 |
| 8,683,694 | B1 | 4/2014 | Emanuel | |
| 2001/0014250 | A1 | 8/2001 | Plummer et al. | |
| 2003/0089054 | A1 | 5/2003 | Hornung | |
| 2004/0035082 | A1 | 2/2004 | Hudoba et al. | |
| 2004/0211134 | A1 | 10/2004 | Glover et al. | |
| 2005/0081981 | A1 * | 4/2005 | Heikkila | 156/109 |
| 2005/0210777 | A1 * | 9/2005 | Baughn et al. | 52/202 |
| 2006/0010796 | A1 | 1/2006 | Akutsu | |
| 2006/0260227 | A1 | 11/2006 | Winfield | |
| 2007/0234677 | A1 * | 10/2007 | Sironko et al. | 52/656.1 |
| 2010/0018139 | A1 | 1/2010 | Brunnhofer | |
| 2011/0041430 | A1 | 2/2011 | Baughn et al. | |
| 2012/0279166 | A1 * | 11/2012 | Valler et al. | 52/656.2 |
| 2013/0111846 | A1 * | 5/2013 | Emanuel | 52/656.9 |
| 2013/0111847 | A1 * | 5/2013 | Emanuel | 52/656.9 |

OTHER PUBLICATIONS

"File History", from U.S. Appl. No. 13/604,037, Entitled "Structural Frame Member Having a Capped Corner Key Passage", filed Sep. 5, 2012 (120 pages).

"File History", from U.S. Appl. No. 13/655,541, Entitled "Frame Members, Corner Key and Assembly Method", filed Oct. 19, 2012 (142 pages).

"Inline Fiberglass 900 Series Windows Vertical Double Hung Tilt Window Drawings and Photographs", At least as early as Nov. 3, 2010 (2 pages).

"Milgard 3285U Ultra Fiberglass Double Hung Replacement Window Assembly Drawings", Feb. 2009 (2 pages).

"Parco Double Hung Window Frame Photograph and Webpage www.parcowindows.com/double_hung.html", At least as early as Nov. 3, 2010. (2 pages).

"Pella Impervia Double Hung Window Frame Drawings", At least as early as Apr. 30, 2010. (3 pages).

"SureView 3500 Series Brochure for Casement Window", At least as early as Nov. 3, 2010. (2 pages).

"SureView 6500 Double Hung Window Brochure and Photographs", At least as early as Nov. 3, 2010. (4 pages).

"File History", for U.S. Patent No. 8,683,694, filed with the USPTO on Oct. 24, 2013. (104 pages).

"Final Office Action", for U.S. Appl. No. 13/667,561, mailed Oct. 10, 2013 (14 pages).

"Non-Final Office Action", for U.S. Appl. No. 13/667,561, mailed Apr. 18, 2014 (8 pages).

"Response to Final Office Action", for U.S. Appl. No. 13/667,561, filed Apr. 10, 2014 (8 pages).

* cited by examiner

FRAME ASSEMBLY HAVING A CORNER KEY

This application claims the benefit of U.S. Provisional Application No. 61/555,384, filed Nov. 3, 2011, U.S. Provisional Application No. 61/558,919, filed Nov. 11, 2011, and U.S. Provisional Application No. 61/587,364 filed Jan. 17, 2012, the contents of which are each incorporated herein by reference in their entireties.

SUMMARY OF THE INVENTION

In one embodiment, a frame assembly includes at least two frame members, each frame member comprising two mitered ends and defining an interior space divided into at least three longitudinal cavities, wherein one of the at least three cavities is a corner key cavity. The frame assembly further includes at least one corner key, wherein each corner key has a first half and a second half, wherein each half of each corner key is configured to fit into one end of one of the corner key cavities to form a corner. The frame assembly further includes adhesive inside the frame members at the corner of the two frame members bonding the frame members and corner key. When the at least two frame members are joined using the corner key, the frame assembly system defines an outer perimeter and an inner perimeter, and the corner key cavity is adjacent to the outer perimeter of the frame assembly system. The outer perimeter of the frame assembly includes a contact portion configured to contact another frame assembly or a structure, wherein the corner key cavity extends across at least 90% of the contact portion of the outer perimeter of the frame assembly.

In another embodiment, a frame assembly method includes providing at least a first and second frame member, each frame member defining an interior space divided into at least three longitudinal cavities, wherein one of the at least three cavities is a corner key cavity. The method further includes providing at least one corner key, wherein each corner key has a first leg and a second leg. The method also includes fitting the first leg of the corner key into one end of the corner key cavity of the first frame member and fitting the second leg of the corner key into one end of the corner key cavity of the second frame member. The method includes inserting adhesive into the first and second frame members. When the first and second frame members are joined using the corner key, the frame assembly system defines an outer perimeter and an inner perimeter, wherein the corner key cavity is adjacent to the outer perimeter of the frame assembly system. The outer perimeter of the frame assembly system includes a contact portion configured to contact another frame assembly or a structure, wherein the corner key cavity extends across at least 90% of the contact portion.

DETAILED DESCRIPTION OF PARTICULAR EMBODIMENTS

The systems and methods described herein relate generally to joining frame members together to form frame assemblies using corner keys which fit inside of the ends of the frame members. More particularly, the systems and methods relate to use of frame members having uniform cross-sections such as those formed by pultrusion or extrusion.

In some embodiments, the frame assembly described herein provides a high level of thermal insulation by virtue of having two or three enclosed longitudinal cavities defined within each frame member. In one embodiment, the frame assembly includes one or more corner keys which are positioned adjacent to an outer perimeter of the assembled frame. In some embodiments, the frame member configuration permits insertion of the corner keys without any milling, that is, without removing any material from the interior of the frame member.

Each frame assembly defines an inner perimeter and an outer perimeter. In some embodiments, this corner key cavity is located adjacent to an outer perimeter of the assembled frame. This position of the corner key improves the strength, rigidity and design pressure of the assembled frame.

An example of a frame assembly is a window frame. Another example of a frame assembly is a window sash designed to fit within a window frame. Both of these examples of frame assemblies have outer perimeters that are designed to contact another frame assembly or structure. The window frame is configured to contact a structure such as a wall of a building. The window sash is designed to contact a window frame. Such frame assemblies define an outer perimeter which includes a contact portion. The contact portion is the portion of the outer perimeter of the frame assembly that is configured to contact another frame assembly or structure. In one embodiment, a corner key cavity extends across at least 90% of the contact portion of the outer perimeter.

In one embodiment, a corner key cavity extends across at least 60% of a depth of a frame member.

In one embodiment, the corner key itself extends across at least 90% of the contact portion of the outer perimeter. In one embodiment, the corner key extends across at least 60% of a depth of a frame member.

In the FIGS., various embodiments are illustrated. Like numbers refer, where appropriate, to like parts throughout the several views.

Figure 1:
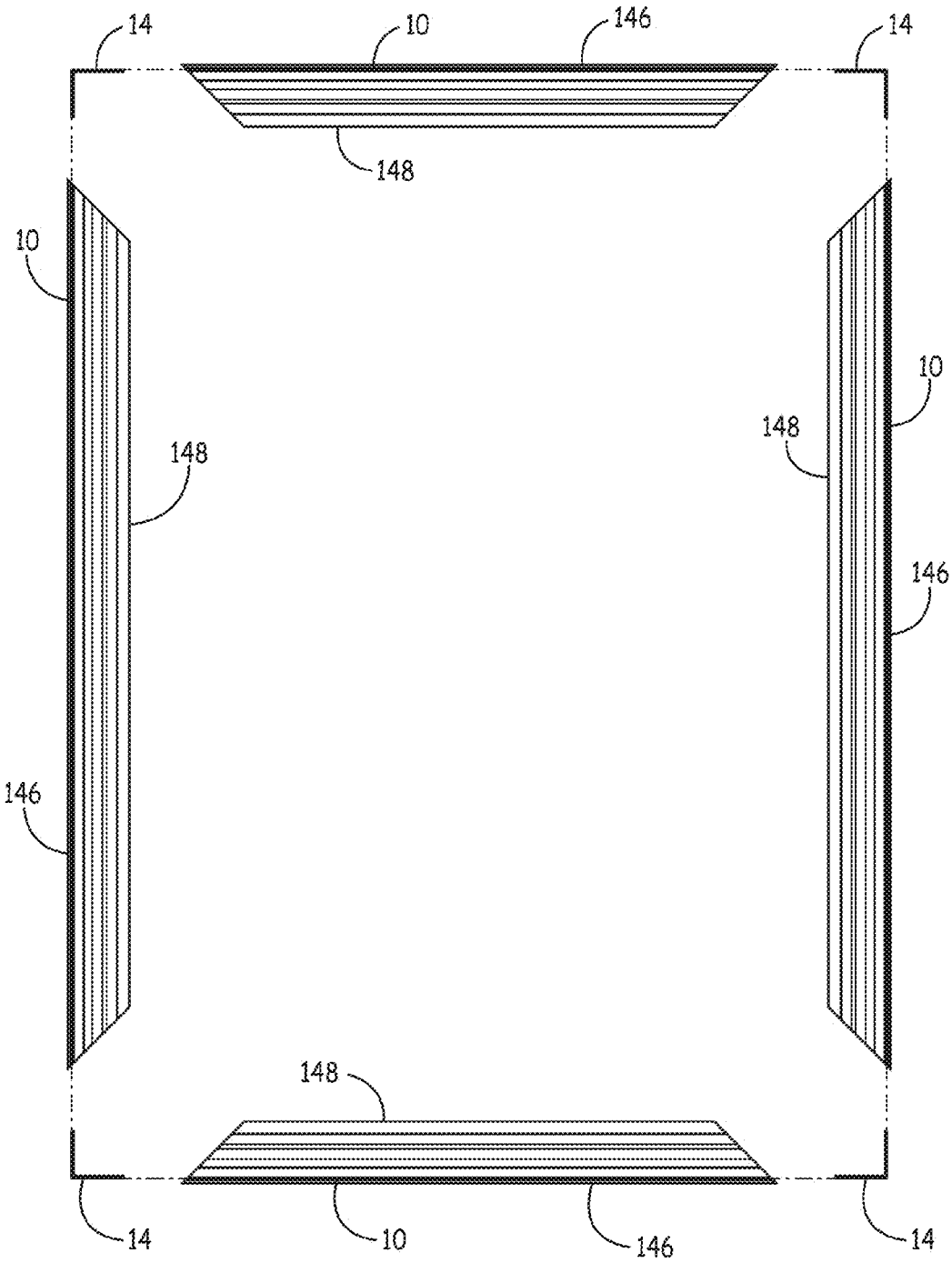
FIG. 1 depicts a front, partial exploded view of one embodiment of a frame assembly system.
Figure 2:
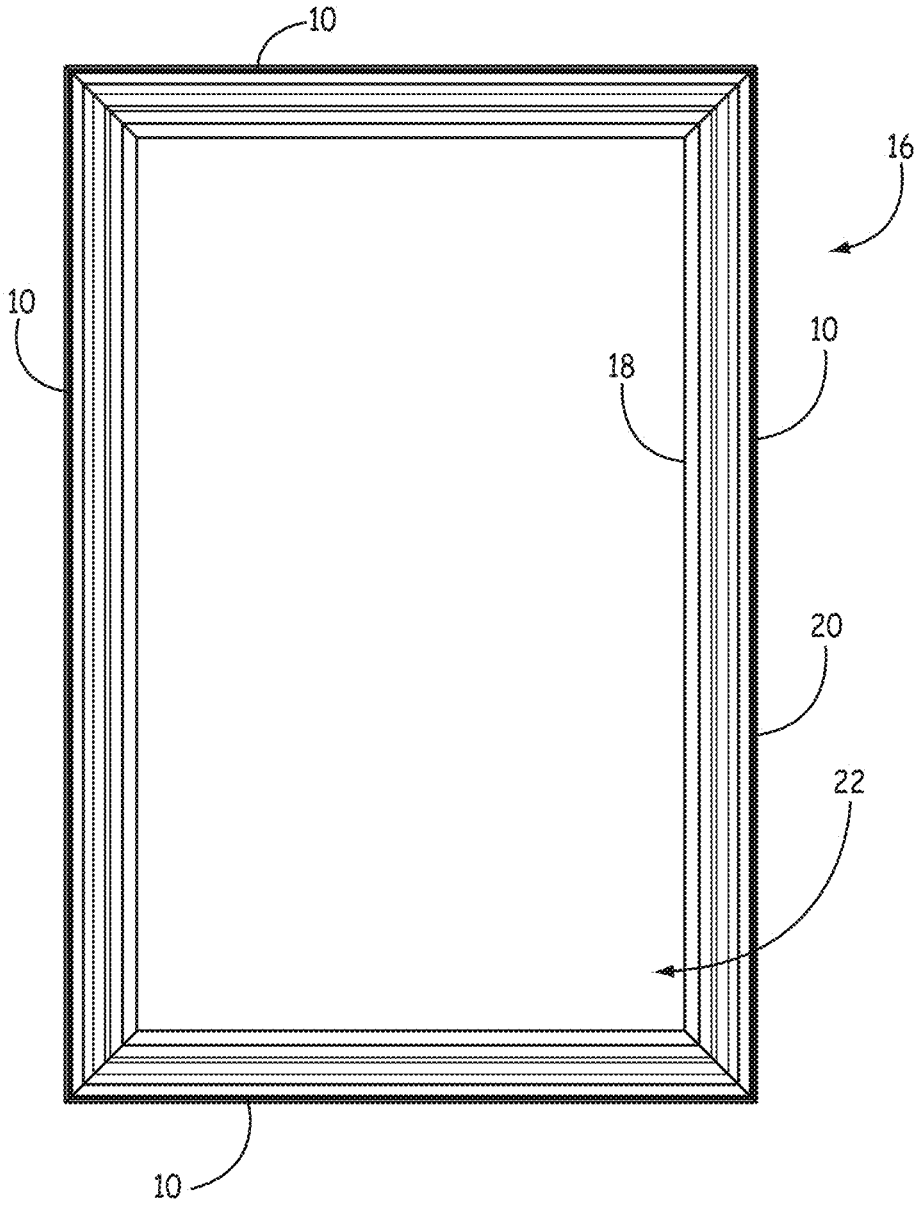
FIG. 2 depicts an assembled frame.

Now referring to FIG. 1, an exploded view of a frame assembly is illustrated including four frame members 10 having mitered ends and four corner keys 14. FIG. 2 shows an assembled frame 16 including the four frame members 10. The corner keys are not visible in FIG. 2 because each corner key 14 fits within the interior cavities of two adjacent frame members 10 to form a corner joint. The frame 16 defines an inner perimeter 18 and an outer perimeter 20. The opening 22 defined by the frame's inner perimeter 18 may be configured to mate with a window sash. The sash or the opening 22 may hold a pane of glass, an insulating glass unit, other transparent or translucent material, or a sheet of material. Now referring to FIG. 1, each of the frame members 10 include an outer perimeter face 146 which, when joined together, will form the outer perimeter 20 shown in FIG. 2.

The concepts related to frame members and assembly methods described herein are sometimes described in the context of windows. However, the same concepts apply to joining other structural or architectural elements at a corner joint. Many of the embodiments described herein have four frame members forming a frame assembly. However, it is also possible to apply the concepts described herein to an assembly that has two frame members, three frame members, five frame members, six frame members, and other numbers of frame members. Where a frame assembly does not form a closed perimeter, such as where there are two frame linear members at right angles to each other, the inner perimeter can be defined on the side of the frame assembly that has an angle between the frame members of less than 180 degrees. The outer perimeter can be defined on the side of the frame assembly that has an angle between frame members of greater than 180 degrees.

The frames of FIGS. 1-2 are rectangular frames. However, it is also possible to apply the frame assembly concepts described herein to non-rectangular frames, such as trapezoidal window frames, half-circle window frames, and other window frames, as will be discussed further herein.

Figure 3:
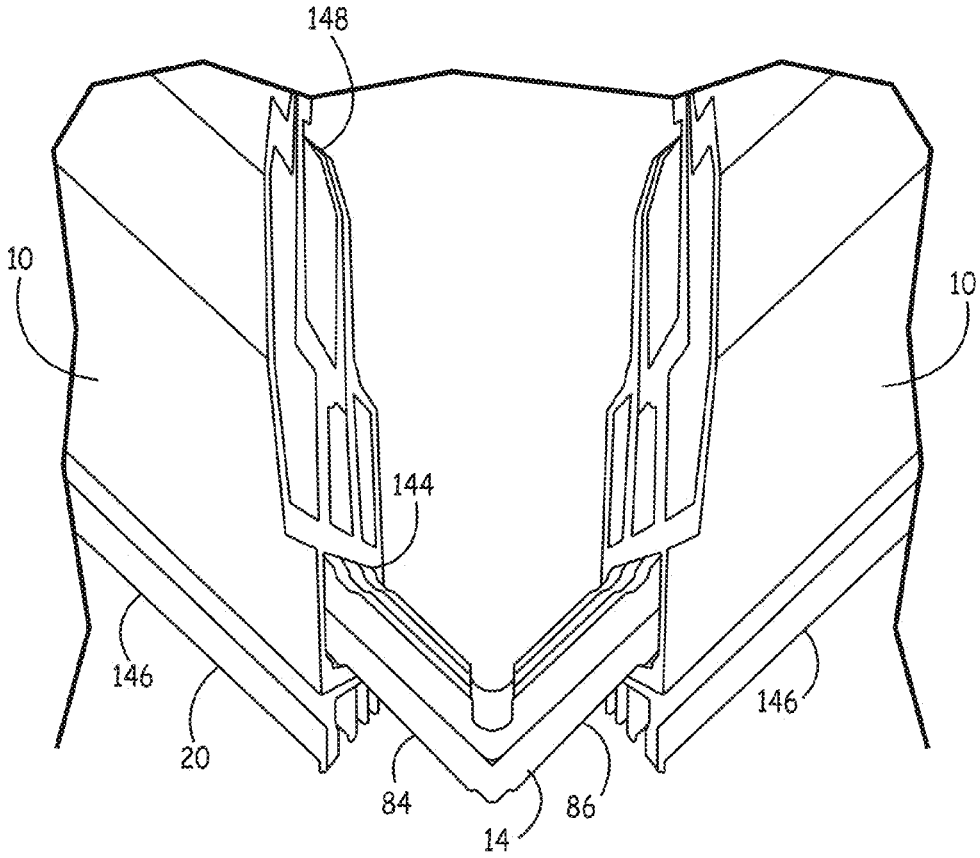
FIG. 3 depicts a front view of two frame members and a corner key partially inserted into the frame members.

Now referring to FIG. 3, each corner key 14 is configured with two legs 86, 88 or two halves that each extend into and fit within the hollow profiles of the adjacent frame members 10 to join the ends of the frame members 10 together. In one embodiment, the corner key is adjacent to the outer perimeter 20 of the frame assembly, which is formed by the outer perimeter faces 146 of each of the frame members 10.

Adhesives can be injected into the corners through specially designed passages to bond the corner keys 14 within the frame members 10 and thereby to secure the ends of the frame members 10 permanently together. In one embodiment, the adhesive is a two-part adhesive. The adhesive is selected to be compatible with the material of the frame member 10 and the material of the corner key 14. One example of a two-part adhesive is NovaGard 900-200 Corner Key Bonding Adhesive, available from NovaGard Solutions, Cleveland, Ohio, which is compatible with the resins in a fiberglass frame member 10 and compatible with a corner key 14 made of acrylonitrile-butadiene-styrene (ABS). In one embodiment, the adhesive when cured forms a polymer. In one embodiment, a hot melt adhesive is injected at the corners. In one embodiment, a thermoplastic adhesive is injected at the corners.

Figure 4:
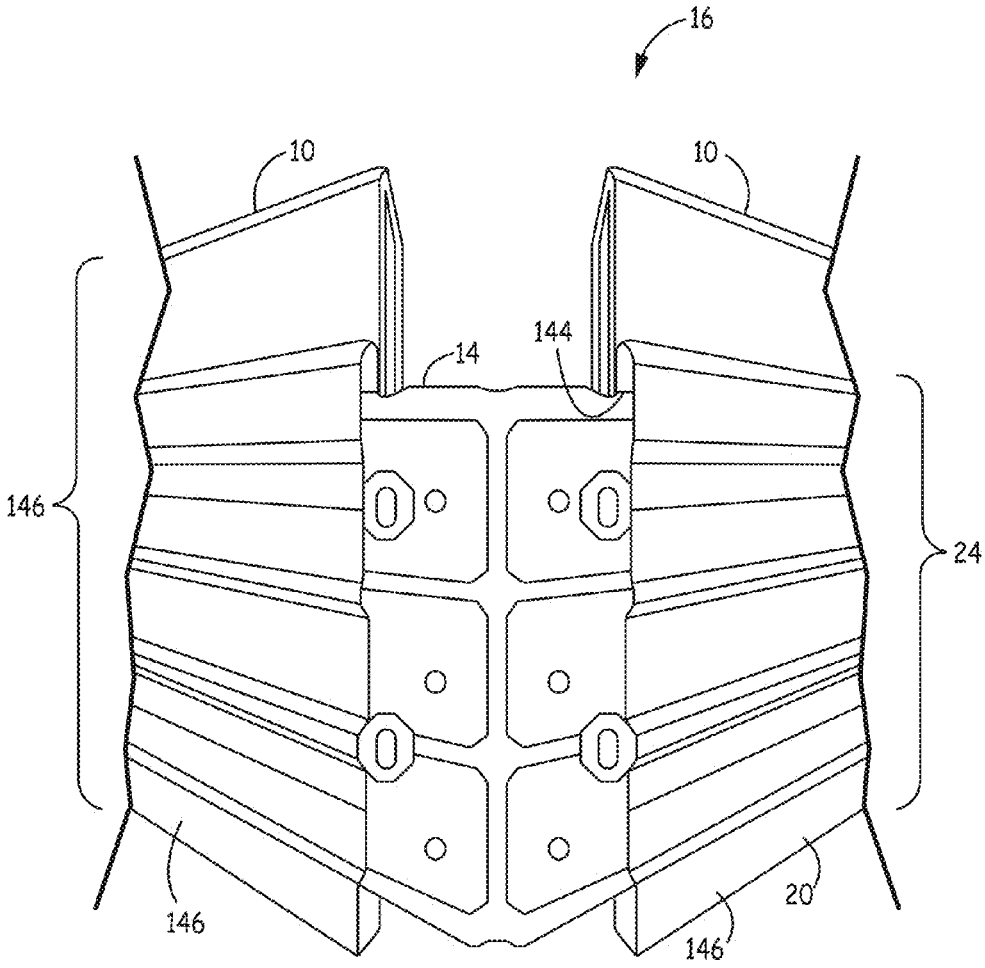
FIG. 4 depicts a view of the exterior perimeter of a partially assembled frame at a corner location, where the partially assembled frame includes two frame members and a corner key partially inserted into the frame members.

FIG. 4 depicts a view of the outer perimeter 20 of the frame assembly 16 from outside of a partially assembled frame assembly. The partially assembled frame assembly 16 includes two frame members 10 and a corner key 14 partially inserted into the frame members 10. The outer perimeter of the frame assembly 20 includes a contact portion 24 which is configured to be in contact with a structure such as a wall in building. The corner key 14 extends across the length of the contact portion 24. The corner key cavity 144 also extends across the length of the contact portion 24.

Figure 5:
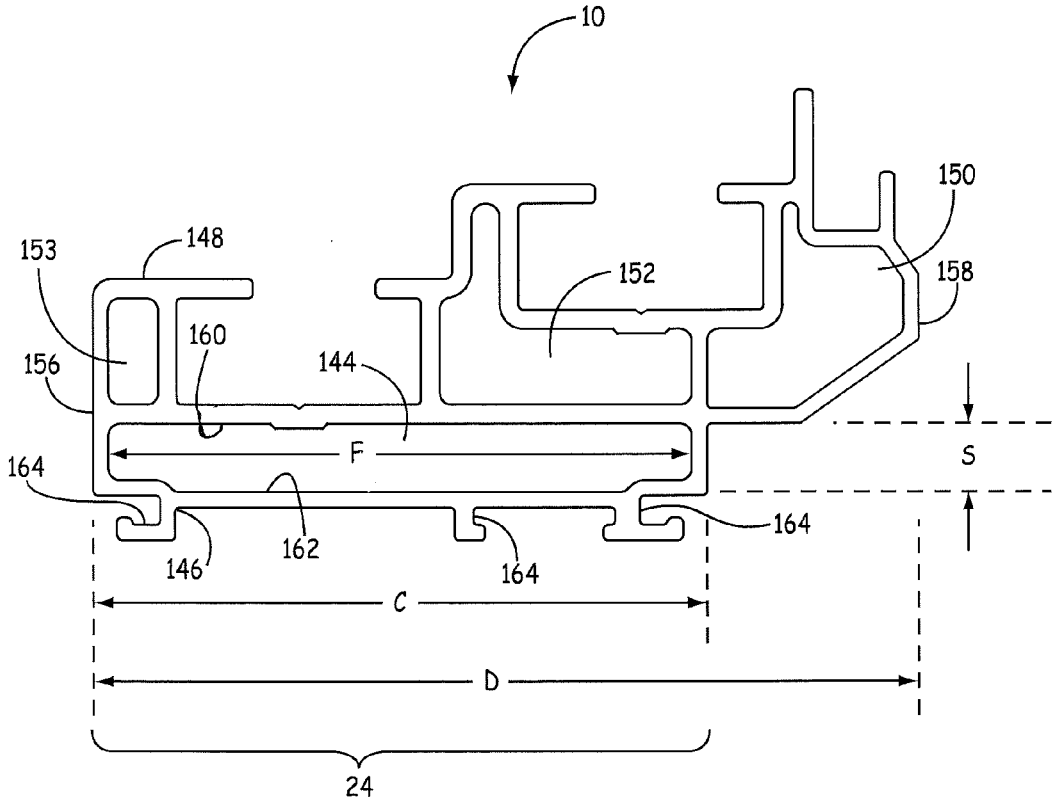
FIG. 5 depicts a cross-sectional view of a frame member for a double-hung window frame which is a component of the frame assembly of FIGS. 1 and 2, consistent with the technology disclosed herein.

FIG. 5 is a cross-sectional view of one example of a frame member 10, which includes a corner key cavity 144 located adjacent to an outer perimeter face 146 of the frame member 10. The outer perimeter face 146 is the face that will form part of the outer perimeter of the frame assembly 16 when the frame members 10 are joined together using a corner key, while the inner perimeter face 148 is the side of the frame member 10 that will form part of the inner perimeter of the frame assembly 16. The frame member 10 defines additional cavities that are adjacent to the inner perimeter face 148, including first inner cavity 150, second inner cavity 152 and third inner cavity 153. These three sealed cavities improve the thermal insulation value of the frame assembly 16. The second inner cavity 152 is located between the first inner cavity 150 and the third inner cavity 153.

The frame member 10 has a uniform cross section along its length. Each of the cavities, including the corner key cavity 144, is longitudinal cavities that extend along the entire length of the frame member 10 and have a uniform cross-section. Each cavity is bounded by a closed perimeter.

The outer perimeter face 146 of the frame member 10 includes a contact portion 24 which is configured to be in contact with a structure such as a wall in building, or a window frame. The length of the contact portion 24 is indicated as C in FIG. 5. The width of the corner key cavity 144 is indicated as E in FIG. 5. In one embodiment, the corner key 14 and the corner key cavity 144 extend across most of the length C of the contact portion 24. In one embodiment, the corner key 14 and the corner key cavity 144 extend across at least 90% of the length C of the contact portion 24. In one embodiment, the corner key 14 and the corner key cavity 144 extend across at least 94% of the length C of the contact portion 24. In one embodiment, the corner key 14 and the corner key cavity 144 extend across at least 95% of the length C of the contact portion 24. In one embodiment, the corner key cavity 144 extends across the entire length C of the contact portion 24. In one embodiment, the corner key 14 extends across the entire length C of the contact portion 24. In one embodiment, both the corner key 14 and the corner key cavity 144 extend across the entire length C of the contact portion 24.

In some embodiments, the contact portion 24 has a length C of 3¼ inch, which is a common window frame sash cavity depth in existing houses in the United States. In some embodiments, the contact portion has a length C of up to 8 inches or more, which is a common window frame depth for new construction in the United States.

Figure 6:
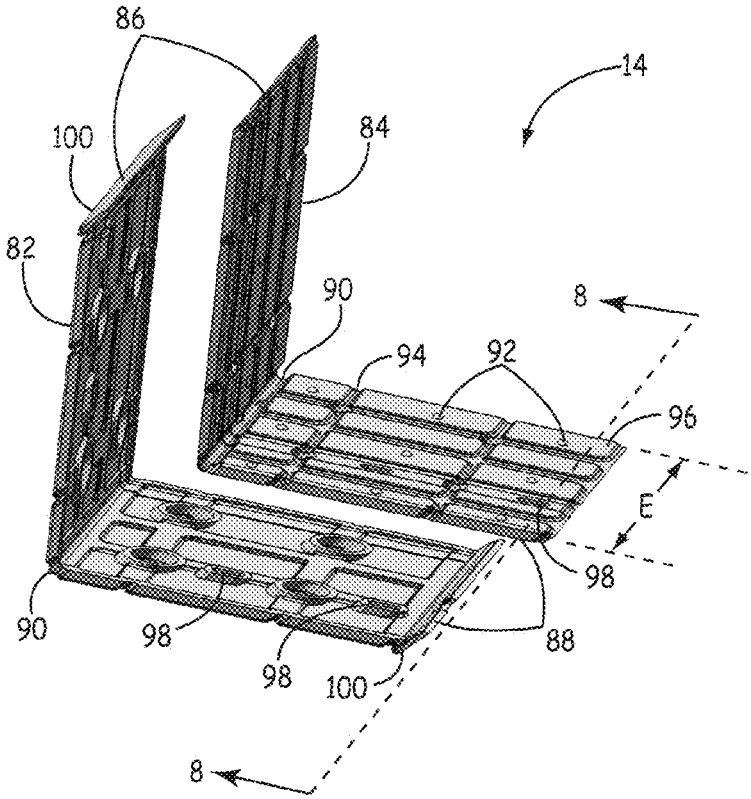
FIG. 6 is a perspective, exploded view of a corner key, including two parts.

In some embodiments, the corner key cavity 144 extends across most of the depth dimension of the frame member, thereby further increasing the strength of the assembled frame 16. The depth dimension D (shown in FIG. 5) of the frame member 10 is measured from a first face 156 to a second face 158 of the frame member 10. In one embodiment, the first face 156 is in the interior of a structure when the frame assembly is installed while the second face 158 is in an exterior of a structure. The depth extension E of the corner key 14 is measured across each of the legs 86, 88 of the corner key 14 as shown in FIG. 6. The corner key 14 fits snugly into the corner key cavity 144 and fits with a friction fit into the corner key cavity 144. As a result, another way to measure the depth extension E of the corner key 14 is by measuring the inside dimension F of the corner key cavity 144. As shown in FIG. 5, the depth extension F of the corner key 14 can be measured across the inside surfaces of the corner key cavity 144.

In some embodiments, the corner key cavity width E extends across at least about 60% of the depth of the frame member D. In some embodiments, the corner key cavity extends across at least about 65% of the depth of the frame member. In some embodiments, the corner key cavity extends across at least about 67% of the depth of the frame member. In some embodiments, the corner key cavity extends across at least about 70% of the depth of the frame member. In some embodiments, the corner key cavity extends across at least about 72% of the depth of the frame member. In some embodiments, the corner key cavity extends across at least about 75% of the depth of the frame member. In the embodiment of FIG. 5, the corner key extends across about 71% of the depth of the frame member.

In some embodiments, the frame depth is co-extensive with the contact area. In other words, the frame assembly contacts another structure along its entire depth. In some embodiments, the corner key cavity extends across at least about 95% of the depth of the frame member. In some embodiments, the corner key cavity extends across at least about 99% of the depth of the frame member. In some embodiments, the corner key cavity extends across the entire depth of the frame member. In some embodiments, the corner key does not extend to the inner perimeter face 148 of the frame member 10. In some embodiments, the distinct interior cavities such as cavities 150, 152 and 153 are present between the corner key cavity 144 and the inner perimeter face 148.

In one embodiment, the frame member defines a corner key cavity and at least one other interior cavity. In one embodiment, the frame member defines a corner key cavity and at least two other interior cavities. In one embodiment, the frame member defines a corner key cavity and at least three other interior cavities. In one embodiment, the frame member defines a corner key cavity and at least four other interior cavities.

In the cross-section of FIG. 5, additional features of the frame member 10 are visible which are present in some embodiments. The frame member 10 defines accessory grooves 164 on the outer perimeter face 146. The accessory grooves can be used for many different purposes. Some examples of uses for the accessory grooves include assisting with mulling multiple windows into a joined arrangement, to attach a nail fin for use in a new construction context, to attach to a brick mold and to attach sill extenders.

In one embodiment, a frame assembly includes a sloped sill portion and the corner key cavity has a 45 degree angle cut to accommodate the sloped sill portion of the lineals.

Figure 7:
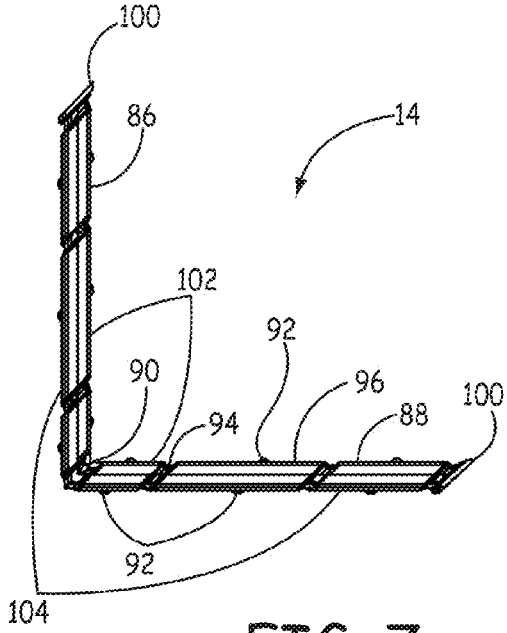
FIG. 7 is a side view of an assembled corner key of FIG. 8.

FIG. 6 is an exploded perspective view of the two parts that make up the corner key 14 in one embodiment. The outer portion 82 attaches to the inner portion 84 using interlocking mechanical structures to form the corner key 14. FIG. 7 is a side view of the corner key 14 after the two parts 82, 84 are joined. By making the corner key 14 in two parts, ease of manufacturing is increased. Also, the two-part corner key 14 allows adhesive to flow between the inner portion 84 and outer portion 82. The corner key 14 of FIGS. 6 and 7 has been found to be structurally solid after the adhesive is injected and has cured.

Now referring to FIG. 7, one embodiment of the corner key 14 includes a first leg 86 and a second leg 88 forming a 90 degree angle. In other embodiments, the angle is not 90 degrees. In other embodiments, the angle between the legs is adjustable. During the assembly of a frame, the first leg 86 is inserted into the end of a corner key cavity 144 of a first frame member 10, while the second leg 88 is inserted into the end of a corner key cavity 144 of another frame member 10. The corner key 14 is dimensioned and configured so that it will fit tightly within the corner key cavities 144. As a result, the two frame members 10 are joined adjacent to a corner key joint 90.

The corner key joint 90 is the portion of the corner key 14 where the two legs 86, 88 or two halves are connected. In one embodiment, the joint 90 of the corner key 14 is flexible and acts as a hinge. As a result, the angle between the first and second legs 86, 88 can vary as needed depending on the frame shape. In another embodiment the joint 90 is rigid and holds the two legs 86, 88 at a 90 degree angle or another angle.

The corner key 14 includes channels and recesses for routing and retaining adhesive that is injected into the corner area after the corner key 14 is positioned within adjacent frame members 10. The adhesive improves the structural integrity of the joint. The corner key 14 can be made from a wide variety of materials including nylon and acrylonitrile-butadiene-styrene (ABS). In one embodiment, the corner key 14 is made from a non-metallic material.

The corner key 14 is configured to fit tightly within the corner key cavity 144. The corner key cavity 144 and the corner key 14 are designed to encourage the adhesive to flow along each leg 86, 88, up against the ramp structures at the ends of the legs, through openings in the corner key and to spaces between inner and outer portions 82, 84. A measured amount of adhesive is injected into the joint once the corner key 14 is in place. Portions of the corner key 14 will be in contact with the interior surfaces of the corner key cavity, while other portions will be spaced away from the interior surfaces and will allow room for adhesive between the corner key and the interior surfaces. Bumps 92 on both sides of the legs 86, 88 are designed to be in contact with the interior surfaces of the corner key cavity. Channels 94 will not be in contact with the interior surfaces of the corner key cavity, and will allow space for adhesive to flow to different portions of the corner area. Flat areas 96 are defined between the channels 94. The flat areas 96 are spaced away from the interior surfaces of the corner key cavity because the bumps 92 are present on the flat areas 96. As a result, adhesive can be present between the flat areas 96 and the interior surfaces of the corner key cavity 144. Openings 98 are provided to allow adhesive to flow from one side of the corner key to the other. The ramps or stops 100 are angled portions present at the ends of the two corner key legs 86, 88. The stops 100 encourage the adhesive to stay near the corner instead of flowing freely into the hollow interior of the frame member beyond the end of the corner key.

In one embodiment, adhesive fills all the cracks and crevices in the joint area. The corner key includes an interior face 102 and an exterior face 104. Referring now to FIG. 5, the corner key cavity includes an inner side surface 160 and an outer side surface 162. Now referring to FIGS. 5, 7 and 8, in one embodiment, in the assembled frame, adhesive is present both between the interior face 102 of the corner key and the inner side surface 160 of the corner key and between the exterior face 104 of the corner key and the outer side surface 162 of the corner key cavity interior surfaces. In one embodiment, adhesive 110 is present on all four sides of each leg 86, 88 the corner key 14.

Figure 8:
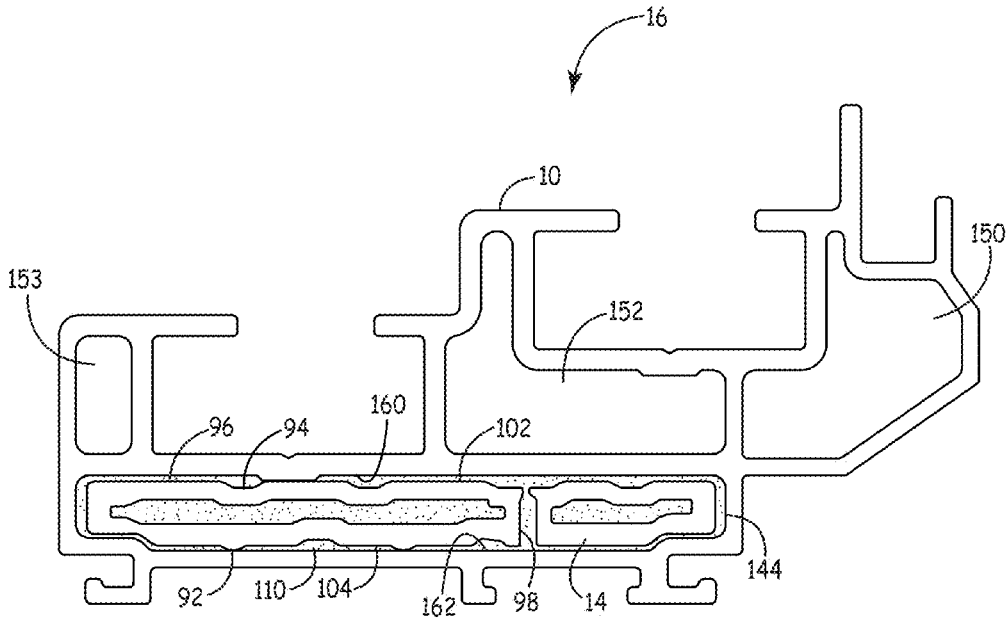
FIG. 8 depicts a cross-sectional view of an assembled frame, taken through the frame member and a leg of the corner key, where adhesive is present inside of the frame member.

FIG. 8 is a cross-sectional view through a frame assembly 16 which includes a frame member 10, a corner key 14 and adhesive 110. The cross-section is taken along a portion of the frame assembly 16 that overlaps with the corner key 14. Section line 8-8 in FIG. 6 indicates the location on the corner key 14 of the cross-section of FIG. 8. In one embodiment, as shown in FIG. 8, adhesive 110 is present between the corner key 14 and the interior surfaces of the corner key cavity 144. In one embodiment, the adhesive 110 surrounds and is present on all sides of the corner key 14.

The shape of the corner key 14 closely matches the shape of the corner key cavity 144. As a result, there is only a small amount of space between the corner key 14 and the corner key cavity 144 that can be occupied by adhesive 110.

Adhesive 110 is also shown in FIG. 8 within the interior of the corner key 14. In one embodiment, there is some adhesive 110 present in the interior of the corner key 14 between the corner key outer half 82 and the inner half 84 but the interior is not completely filled with adhesive 110.

As seen in FIGS. 5 and 8, the corner key cavity extends across the contact portion 24 of the outer perimeter of the frame assembly and is adjacent to the outer perimeter. Also, the adhesive 110 surrounds the corner key 14. These features provide a more weather tight and air tight construction of the frame assembly 16.

In one embodiment, the frame members are cut from lineal stock. In one embodiment, the frame members are formed to the lengths needed for constructing a frame assembly. In some embodiments, the frame members define a substantially hollow profile, though the interior cavity is divided into multiple cavities by interior walls in some embodiments.

In one embodiment, the frame members are made of pultruded fiberglass material. In another embodiment, the frame members are made of an extruded thermoplastic composite material. One example of a thermoplastic composite material includes wood and polymer. A product of an extrusion process can be referred to as an extrudate. An extrudate has a uniform cross-section along its length. The frame members, lineal members and cap can be extrudates. In one embodiment, the frame members are made of vinyl.

Both pultrusion and extrusion processes form long parts with a uniform or constant cross-sections along their lengths which are also referred to as lineals. The lineal may be miter cut or cut in other ways at their ends to allow formation of an attractive joint with another lineal. The lineals may be cut to form the appearance of a mortise and tenon joint, while still using a corner key to join two frame members.

Additional embodiments of a frame assembly with the corner key located at an outer perimeter and extending across a significant portion of the contact area are described in U.S. Provisional Application 61/558,919, titled "Frame Members, Corner Key and Assembly Method," filed on Nov. 11, 2011, which is hereby incorporated herein in its entirety. Some of the embodiments described in Provisional Application 61/558,919 have frame members that include cap members.

There are many possible embodiments of methods of forming a frame assembly. In one embodiment, stock members such as the lineal members, the caps and/or frame assemblies are formed using pultrusion or extrusion so that each member has a uniform cross section over its length. In one embodiment, the members are formed by pultrusion of fiberglass.

In one embodiment, fairly long stock frame members and frame member components are formed by extrusion or pultrusion. The stock members can be formed in a standard length, such as sixteen foot lengths. In one embodiment, the frame members and frame member components are formed in the specific lengths that are needed for making frame assemblies.

In some embodiments, each frame member has a uniform cross section along its length. The cavities that are defined within the frame member will also have uniform cross sections across their lengths. Each frame member includes a first end and a second end. The first and second ends are angled ends in one embodiment. In some embodiments, the length of the frame member, lineal member or cap which extends between the angled ends has a uniform cross section.

In some embodiments, the frame members and frame member components are painted or laminated after formation. The paint coating or lamination covering can provide increased durability and aesthetic changes to the frame members.

To construct a particular frame assembly from stock frame members, one step is to cut the stock frame members to the appropriate length with the appropriate miter cut at the ends. Another step is performance of routing operations such as forming adhesive injection holes, forming venting holes, forming weep holes for water management, forming window balance knock-outs and other routing operations as appropriate for the type of window. Hardware may also be added if appropriate.

Another possible step is to apply silicone to the ends of each of the frame members before they are joined together. This step provides a more weather tight and air tight construction.

Next, the frame members are brought together using a clamping system, with a corner key positioned at each corner. One leg or one half of the corner key is inserted into one end of a corner key cavity of a frame member. The other leg or half of the corner key is inserted into one end of a corner key of another frame member. Then, adhesive is injected into the joint areas. In one embodiment, each joint area includes two injection holes. Each injection hole is located near one of the legs of the corner key, on opposite sides of the joint 90 of the corner key and close to the joint of the corner key. In this embodiment, two venting holes are also provided close to the joint of the corner key.

In one embodiment, adhesive is used at the joints to enhance the structural integrity of the completed frame. In some embodiments, separate mechanical fasteners are used at the joints, either alone or in addition to adhesive. In one embodiment, the joint is secured with adhesive without the use of any separate mechanical fasteners. When the frame members are formed of hollow profile material as in the preferred embodiments, the ends of the frame members are sometimes mitered. In addition to or instead of adhesive and fasteners, the mitered ends can be joined securely together by other methods, for example, by sonic welding.

In some embodiments, vinyl frame members are used in combination with ultrasonic bonding of the frame members to form a corner joint. However, it may be desirable to touch-up the appearance of the vinyl if the vinyl laminate is modified by the ultrasonic welding. The use of corner keys and adhesive to form the joint reduces the likelihood of performing a touch-up step.

Structural Performance

Windows are classified into performance classes by the window industry, and each performance class has requirements for structural performance. The following are performance classes used in the window industry, in order of increasing requirements for structural performance: Residential (R), Light Commercial (LC), Commercial Window (CW) and Architectural Window (AW). Table 1 summarizes the minimum test requirements for each window type by performance class. The column titled Performance Grade shows the minimum pressure, or design pressure (DP) that must be withstood by a window unit of the specified size for the specified window type, to be classified in each Performance Classification. Optional performance grades may also be specified for each performance class, except Architectural Window, in 5 psf increments above the class minimum, up to a maximum of 100 psf.

TABLE 1

| Minimum Test Requirements for Each Window Type by Class | | Minimum Window Load | | Minimum Test Size By Window Type | |
|---|---|---|---|---|---|
| Performance Classification | Performance Grade (PSF) | Double Hung | 2-Light Slider | Casement | Fixed |
| Residential—R | 15 | 40 × 63 | 63 × 44 | 24 × 60 | 48 × 48 |
| Light Commercial—LC | 25 | 44 × 75 | 71 × 56 | 32 × 60 | 56 × 56 |

TABLE 1-continued

| Minimum Test Requirements for Each Window Type by Class | | Minimum Window Load | | Minimum Test Size By Window Type | |
|---|---|---|---|---|---|
| Performance Classification | Performance Grade (PSF) | Double Hung | 2-Light Slider | Casement | Fixed |
| Commercial Window—CW | 30 | 56 × 91 | 71 × 60 | 36 × 60 | 60 × 60 |
| Architectural Window—AW | 40 | 60 × 99 | 99 × 79 | 36 × 60 | 60 × 99 |

Design pressure (DP) is a metric of a window's strength and is measured in pounds per square foot (psf). Measurement techniques for DP are further described in ASTM E1300, titled "Standard Practice for Determining Load Resistance of Glass in Buildings." Windows according to the discussion herein have a DP of at least 40 psf, a DP of at least 45 psf, a DP of at least 50 psf, a DP of at least 70 psf and DP of 90 psf in various embodiments. Windows with DP of at least 40 psf for the minimum test window size are eligible for the highest performance classification of architectural window. Testing for Design Pressure and several other structural performance criteria was performed using frame members having a profile of the example of FIG. 3 in U.S. Provisional Application 61/558,919 where the frame is constructed of fiberglass, the corner key is constructed of ABS, and NovaGard 900-200 Corner Key Adhesive. The results of these tests for three different window types are shown in Table 2. For a Double Hung window having a size of 44 inches by 75 inches, a design pressure of 45 psf was achieved, warranting and exceeding a Light Commercial Performance Grade. For a 2-Light Slider window configuration having a size of 71 inches by 60 inches, a design pressure of 45 psf was achieved, warranting and exceeding a Commercial Window Performance Grade. For a Casement window configuration having a size of 36 inches by 80 inches, a DP of 45 psf was achieved, warranting and exceeding an Architectural Window Performance Grade. For a Picture Window configuration having a size of 86 inches by 96 inches, a DP of 40 psf was achieved, warranting and exceeding a Commercial Window Performance Grade.

TABLE 2

| Window Type | Size Tested | Performance Class | Air Infiltration (Allowed/Actual) cfm/ft$^2$ | Water Penetration psf | Uniform Load 45.11 psf | Overload |
|---|---|---|---|---|---|---|
| Double Hung | 44" × 75" | LC-PG45 | 0.30/0.20 | 7.52 - DP50 | Pass | Pass |
| 2-Light Slider | 71" × 60" | CW-PG45 | 0.30/0.13 | 7.52 - DP50 | Pass | Pass |
| Casement | 36" × 80" | AW-PG45 | 0.30/0.03 | 10.66 - DP70 | Pass | Pass |
| Picture | 86" × 96" | CW-PG40 | 0.30/<0.01 | 12.11 - DP80 | Pass | Pass |

Another aspect of structural performance of a window is the window's ability to prevent water penetration. Measurement techniques for water infiltration include a 23 minute test with the window closed and locked, subjected to a four cycle test described in ASTM E547. Each cycle consists of a five minute duration with positive pressure applied and one minute duration with pressure released for drainage, but with water spray continuously applied. The minimum test pressure is 15% of the design pressure required for that particular performance grade. For example, the commercial window performance grade requires 30 psf for its DP, and so the water infiltration test will be conducted at 7.5 psf. In order to pass the test, there must be no water present inside the inner most vertical plane of the test window during and at the conclusion of the test. Windows according to the discussion passed the water infiltration test at pressures of up to 7.52 psf and up to 10.66 psf in various embodiments, as summarized in Table 2.

Another aspect of structural performance is air infiltration. The window unit is closed and locked, and is subjected to a pressure of 1.57 psf, which is equivalent to a 25 mile per hour wind, according to the testing procedures of ASTM E 283. Air leakage cannot exceed 0.30 cubic feet per minute per square foot (cfm/ft$^2$). Windows tested met these criteria, as summarized in Table 2.

Another aspect of structural performance is uniform load, where the window is subjected to both positive and negative minimum Design Pressure for each Performance Grade, with deflections recorded during each load, according to ASTM E 330. The windows tested met these criteria, as summarized in Table 2.

Another structural performance parameter is overload, where the window is subjected to 150% of Design Pressure for its Performance Grade, and must exhibit no permanent deformation of any sash or frame part in excess of L/175, where L is the longest unsupported span of a sash, according to ASTM E 330. The windows tested met these criteria, as summarized in Table 2. For example, the Double Hung, 2-Light Slider and Casement windows withstood positive and negative pressures of higher than 67.5 psf (150% of 45 psf) without exhibiting any permanent deformation above the specified amount. The Picture window withstood positive and pressures of higher than 60 psf (150% of 40 psf) without exhibiting any permanent deformation above the specified amount.

Thermal Performance

Thermal performance of a window can be improved by using the frame described herein. The U-factor is a term that is used to quantify heat transfer. The units for U-factor are British thermal unit (Btu) per hour per square foot of area per degree Fahrenheit temperature difference. The computer programs Therm 5 and Window 5 are industry-standard computer tools used to simulate heat flow through the edge of the glass and window frame regions and through the center of glass. These programs also sum up the respective contribution of each component to determine the U-factor for the whole window. These computer programs were developed by the Lawrence Berkeley National Laboratory. Using these computer programs, testing was performed using the example of FIG. 3 in U.S. Provisional Application 61/558,919 where the frame is constructed of fiberglass, the corner key is constructed of ABS, and NovaGard 900-200 Corner Key Adhesive. A U-factor of 0.22 was achieved. An R5 rating is a sought after level of thermal insulation for a window. An R5 rating is achieved if a fixed unit has a U-factor of 0.20 or less. An R5 rating is achieved for an operating window unit where the U-factor is 0.22 or less. Embodiments of a frame assembly using the frame members shown in FIGS. 3, 10, and 11 in U.S. Provisional Application 61/558,919 provided herein achieve an R5 rating.

An example of a system and method for forming a frame assembly has been described, but those of skill in the art will be aware of many options and alternatives to the equipment and method steps described that can be used.

Various embodiments are described in detail with reference to the drawings, wherein like reference numerals represent like parts and assemblies throughout the several views.

Reference to various embodiments does not limit the scope of the claims attached hereto. Additionally, any examples set forth in this specification are not intended to be limiting and merely set forth some of the many possible embodiments for the appended claims.

I claim:

1. A frame assembly including:

(a) at least two frame members, each of the at least two frame members comprising two mitered ends and defining an interior space divided into at least three enclosed longitudinal cavities, wherein one of the at least three cavities is a corner key cavity;

(b) at least one corner key, wherein each of the at least one corner key has a first half and a second half, wherein each half of each of the at least one corner key is configured to fit into one end of one of the corner key cavities to form a corner; and (c) adhesive inside the frame members at the corner of the at least two frame members bonding the at least two frame members and the at least one corner key; and wherein when the at least two frame members are joined using the at least one corner key, the frame assembly defines an outer perimeter and an inner perimeter, wherein the corner key cavity is located along the outer perimeter of the frame assembly;

wherein the outer perimeter of the frame assembly includes a contact portion configured to contact another frame assembly or a structure, wherein the corner key cavity extends across at least 90% of the contact portion of the outer perimeter of the frame assembly.

2. The frame assembly of claim 1 wherein the adhesive surrounds the corner key.

3. The frame assembly of claim 1 wherein the at least one corner key extends across at least 90% of the contact portion of the outer perimeter of the frame assembly.

4. The frame assembly of claim 1 wherein the at least one corner key further comprises a stop member that extends from one interior surface of the frame member to an opposing interior surface of the frame member.

5. The frame assembly of claim 1 wherein each of the at least two frame members has a depth extending from a first face to a second face, wherein the corner key cavity extends across at least 70% of the depth of the frame member.

6. The frame assembly of claim 1 wherein the corner key cavity extends across the entire contact portion.

7. The frame assembly of claim 1 wherein the at least one corner key is configured to friction fit into the corner key cavities.

8. The frame assembly of claim 1 wherein the at least one corner key and the at least two frame members are configured so that the at least one corner key is entirely enclosed within the frame assembly when the at least two frame members are joined using the at least one corner key.

9. The frame assembly of claim 1 wherein each of the at least one corner key comprises one of the group consisting of nylon and acrylonitrile-butadiene-styrene (ABS).

10. The frame assembly of claim 1 wherein the at least one corner key is non-metallic.

11. The frame assembly of claim 1 wherein the assembly does not include a mechanical fastener joining any of the at least two frame members to any of the at least one corner key.

12. The frame assembly of claim 1 comprising four frame members and four corner keys, wherein each of the four frame members and the four corner keys are configured so that when the four frame members are connected to each other using the four corner keys, the four frame members will form 90 degree angles.

13. The frame assembly of claim 1 wherein the frame assembly comprises a sloped sill portion and wherein the corner key cavity comprises a 45 degree angle cut.

14. The frame assembly of claim 1 wherein each of the at least two frame members has a 45 degree angle cut on both ends and the first half of the at least one corner key forms a 90 degree angle with the second half of the at least one corner key.

15. The frame assembly of claim 1 wherein each of the at least two frame members is a unitary structure.

16. The frame assembly of claim 15 wherein each of the at least two frame members comprise vinyl.

17. The frame assembly of claim 15 wherein each of the at least two frame members comprise fiberglass.

18. The frame assembly of claim 15 wherein each of the at least two frame members comprise a thermoplastic material.

19. The frame assembly of claim 1 wherein each of the at least two frame members comprises:

a first mitered end portion and a second mitered end portion; and a length extending between the end portions, the length having a uniform cross section.

20. The frame assembly of claim 1 wherein each of the at least two frame members includes an opening configured to allow injection of adhesive into each of the at least two frame members member overlapping with a location of the at least one corner key when the at least two frame members are joined using the at least one corner key.

21. The frame assembly of claim 20 wherein the opening is located a first distance from an end of one of the at least two frame members.

22. The frame assembly of claim 1 wherein two of the at least three interior longitudinal cavities are present between the corner key cavity and an inner perimeter face of the frame member.

23. The frame assembly of claim 1 wherein one of the at least three interior longitudinal cavities other than the corner key cavity is positioned adjacent to a first interior face of the at least two frame members.

24. A frame assembly method including:

(a) providing a first and second frame member, the first and second frame members defining an interior space divided into at least three enclosed longitudinal cavities, wherein one of the at least three cavities is a corner key cavity; and (b) providing a corner key, wherein the corner key has a first leg and a second leg;

(c) fitting the first leg of the corner key into one end of the corner key cavity of the first frame member;

(d) fitting the second leg of the corner key into one end of the corner key cavity of the second frame member;

(e) inserting adhesive into the first and second frame members;

(f) wherein when the first and second frame members are joined using the corner key, a frame assembly system defines an outer perimeter and an inner perimeter, wherein the corner key cavity is located along the outer perimeter of the frame assembly system;

(f) wherein the outer perimeter of the frame assembly system includes a contact portion configured to contact another frame assembly or a structure, wherein the corner key cavity extends across at least 90% of the contact portion.

25. The frame assembly method of claim 24 wherein two of the at least three interior longitudinal cavities are present between the corner key cavity and an inner perimeter face of the frame member.

* * * * *